United States Patent [19]

Oikawa et al.

[11] Patent Number: 4,813,908

[45] Date of Patent: Mar. 21, 1989

[54] MOTION TOY HAVING ACTION-CHANGING STRUCTURE

[75] Inventors: Shinji Oikawa; Jiro Yamaguchi, both of Tokyo, Japan

[73] Assignee: Iwaya Corporation, Tokyo, Japan

[21] Appl. No.: 100,038

[22] Filed: Sep. 23, 1987

[30] Foreign Application Priority Data

Apr. 27, 1987 [JP] Japan ..... 62-103663

[51] Int. Cl.[4] ..... A63H 3/28; A63H 11/18

[52] U.S. Cl. ..... 446/298; 446/353; 446/484

[58] Field of Search ..... 74/337.5, 89.15, 342, 74/352, 24; 192/94; 446/353, 354, 355, 356, 352, 298, 463, 297, 484

[56] References Cited

U.S. PATENT DOCUMENTS

| | | | |
|---|---|---|---|
| 1,724,094 | 8/1929 | Kuen | 446/355 |
| 2,755,678 | 7/1956 | MacDonald | 74/337.5 |
| 3,429,194 | 2/1969 | Espenschied et al. | 74/337.5 |
| 3,548,672 | 12/1970 | Conrad | 74/337.5 X |
| 4,389,811 | 6/1983 | Iwaya et al. | 446/353 X |
| 4,545,451 | 10/1985 | Pipa et al. | 446/463 X |
| 4,752,272 | 6/1988 | Karasawa | 446/354 X |

*Primary Examiner*—Mickey Yu

*Attorney, Agent, or Firm*—James E. Nilles

[57] ABSTRACT

A motion toy body consisting of a trunk containing a housing therein, and a head; a frame in the housing which can be vertically moved, and which supports a crankshaft on which left and right feet are mounted so that the feet can be moved forward and backward; a slide shaft supported by a frame so that the slide shaft can be moved axially and turned, and which has a change-over gear, adapted to engage and disengage from a foot-driving gear by which power is transmitted to the crankshaft, and a singing gear; a screw on the outer circumferential surface of the slide shaft; a support member fixed to a bottom member of the housing and having a feed screw adapted to be engaged with and disengaged from the screw on the slide shaft and thereby move the slide shaft when the feed screw is engaged with the screw on the slide shaft; a spring fitted around the slide shaft for urging the slide shaft constantly toward the support member; an electric motor fixed to the frame and adapted to turn the slide shaft; a spring provided between the housing and the frame and resiliently supporting the frame with the screw on the slide shaft lower than the feed screw on the support member; a switch mechanism adapted to energize the electric motor when the frame is raised against the spring; and a singing member proivided on the bottom member of the housing and having a slide portion which the singing gear engages and disengages from.

1 Claim, 6 Drawing Sheets

MOTION TOY HAVING ACTION-CHANGING STRUCTURE

BACKGROUND OF THE INVENTION

1. Field of the Invention

This invention relates to an action-changing structure for motion toys, and a motion toy using this action-changing structure, the action-changing structure being adapted to automatically changing the action of a motion toy, this action-changing operation enabling a motion toy to make various kinds of actions.

2. Description of the Prior Art

The structure disclosed in, for example, Japanese patent Publication No. 30592/1986 is known as a conventional action-changing structure of this kind for motion toys. The structure disclosed in this publication is formed as follows. First and second interlocking gears having different numbers of teeth are mounted on a slide shaft pivotably and fixedly, respectively. A change-over locking groove is formed in the side surface of the first interlocking gear which faces the second interlocking gear, in such a manner that this locking groove extends around the center of pivotal movement of the first interlocking gear in concentric relation therewith. A change-over locking projection is formed on the side surface of the second interlocking gear which faces the first interlocking gear, which locking projection is adapted to engage and disengage from the locking groove in accordance with the pivotal movement of the first interlocking gear. These first and second interlocking gears are meshed with a pivotable driving gear, a driving power source common thereto. A changeover gear adapted to engage and disengage from a relay gear, by which the power is transmitted to a motion mechanism, is mounted fixedly on the slide shaft, and a coiled spring constantly urging the second interlocking gear toward the first interlocking gear is also provided on the same slide shaft.

According to the structure disclosed in this publication, the first and second interlocking gears having different numbers of teeth are meshed with the driving gear, and the second interlocking gear is engaged with and disengaged from the first interlocking gear via the engaging and disengaging actions of the locking groove and locking projection in accordance with the pivotal movement of the driving gear by utilizing the difference between the rotational speeds of the first and second interlocking gears and the urging force of the coiled spring, to thereby move the slide shaft in the axial direction and advance and reverse the change-over gear in the same direction. The first and second interlocking gears having different numbers of teeth are engaged with and disengaged from each other as they are meshed with and turned by the common driving gear. Accordingly, in order that these gears are meshed and turned smoothly, it is necessary that these gears be manufactured with a high accuracy. Moreover, much labor is required to form locking groove and projection in and on the first and second interlocking gears of a small diameter. This often gives rise to the problems of the manufacturing cost and the strength of the parts, and causes an increase in the number of parts.

SUMMARY OF THE INVENTION

An object of the present invention is to provide an action-changing structure for motion toys, which is capable of moving a change-over gear-carrying slide shaft simply in the axial direction to enable a motion switching interlocking operation by the change-over gear to be carried out easily, whereby all of the problems of a prior art structure of this kind including the problems of the manufacturing accuracy and cost and the strength and number of parts can be solved.

Another object of the present invention is to provide an interesting motion toy adapted to make special actions by a motion switching operation by a motion change-over mechanism.

The motion change-over structure is provided with a frame, a slide shaft which is supported by the frame so that the slide shaft can be slided axially and turned, and which has thereon a change-over gear adapted to engage and disengage from a gear by which the power is transmitted to a motion mechanism, a screw formed to a predetermined length on the outer circumferential surface of the slide shaft, and a feed screw meshed with the screw on the slide shaft and adapted to move the slide shaft in the axial direction as the shaft is turned.

The motion toy is provided with a toy body consisting of a trunk containing a housing therein, and a head; a frame which is provided in the housing in the toy body so that the frame can be vertically moved, and which supports thereon a crankshaft, on which left and right feet are mounted so that these feet can be moved forward and backward, in such a manner that the crankshaft extends horizontally and can be turned; a slide shaft which is supported by the frame so that the slide shaft can be moved axially and turned, and which has thereon a change-over gear, which is adapted to engage and disengage from a foot-driving gear by which a power is transmitted to the crankshaft, and a singing gear; a screw formed to a predetermined length on the outer circumferential surface of the slide shaft; a support member fixed to a bottom member of the housing and having on the upper portion thereof a feed screw adapted to be engaged with and disengaged from the screw on the slide shaft and thereby move the slide shaft when the feed screw is engaged with the screw, in the axial direction as the slide shaft is turned; a spring fitted around the slide shaft and urging the slide shaft constantly toward the support member; an electric motor fixed to the frame and adapted to turn the slide shaft; a spring provided between the housing and frame and resiliently supporting the frame with the screw on the slide shaft lower than the feed screw on the support member; a switch means adapted to energize the electric motor when the frame is raised against the spring; and a singing member provided on the bottom member of the housing and having a slide portion which the singing gear engages and disengages from.

When the slide shaft in the motion change-over structure for motion toys is turned, it is moved as it is turned axially by the feed screw engaged with the screw formed thereon, and the change-over gear mounted on the slide shaft is meshed automatically with the gear, by which the power is transmitted to the motion mechanism, as the change-over gear is turned, the power from the change-over gear being transmitted to the motion mechanism via the transmission gear. Due to the further axial movement of the slide shaft, the change-over gear disengages from the gear, by which the power is transmitted to the motion mechanism, to discontinue the transmission of the power to the motion change-over structure.

When the upper portion of the head of the toy body of the motion toy is knocked, the housing the bottom portion of which contacts the floor surface is not moved down but the frame is lifted against the spring as the frame is supported on the lower end portions of the left and right feet contacting the floor surface. When the frame is further lifted, the end surface of the screw on the slide shaft is displaced to the upper side of the inner surface of the support member, and the slide shaft is moved automatically in the axial direction toward the support member by the return force of the spring to cause the screw on the slide shaft to be meshed momentarily with the feed screw formed on the support member. Due to the meshing of this feed screw with the screw on the slide shaft, the singing gear mounted on the slide shaft engages the slide portion of the singing member. When the frame is lifted to cause the feed screw and the screw on the slide shaft to be meshed with each other as mentioned above, the switch means is turned on. Consequently, the electric motor is energized, and the slide shaft is turned via a gear interlocking mechanism. When the slide shaft is thus turned, the screw formed thereon is turned with respect to the feed screw on the support member, and, at the same time, the singing gear contacts slidingly and turns at its teeth the slide portion of the singing member intermittently with mincing steps against the resilient force of the slide portion. The screw on the slide shaft is moved axially by the feed screw as the former is turned, and the slide shaft is moved axially as it compresses the spring thereon against the resilient force thereof, the singing gear on the slide shaft being moved axially as it contacts slidingly and turns the slide portion. In this motion toy, a sound similar to a metallic sound of a curved tone occurs momentarily when the singing gear contacts slidingly and turns the slide portion. This sound of a curved tone echoes greatly within the machine frame and is heard like a scream of an animal. Namely, when the head of the toy body is knocked, a screaming action is made momentarily. When the screw on the slide shaft is further moved in the axial direction by the feed screw, the former screw disengages from the latter screw, and the singing gear also disengages from the slide portion due to the axial movement of the slide shaft. Consequently, the scream is interrupted, while the change-over gear is meshed with the foot-driving gear owing to the axial movement of the slide shaft.

When the screw on the slide shaft has disengaged from the feed screw, the frame moves down due to the return force of the spring, and the end surface of the screw engages the guide surface on the inner side of the support member to cause the left and right feet to project outward. The left and right feet press at their lower portions the floor surface, so that the toy body inclines slightly in the backward direction, the switch means being then turned off. When the change-over gear is then meshed with the feet-driving gear, the latter is turned by the former, and the crankshaft is also turned. Owing to the turning of the crank arms at both end portions of the crankshaft, the left and right feet are moved forward and backward alternately, so that the toy body makes a forward walking action for a predetermined period of time. Thus, the toy body is set in advance so that, when the head is knocked, a screaming action is made momentarily, and so that, the moment the screaming action ceases, the toy body walks about in the forward direction for a predetermined period of time, for example, several seconds.

Other objects and characteristic features of the present invention will be described with reference to the accompanying drawings.

DESCRIPTION OF THE PREFERRED EMBODIMENTS

Figure 1:
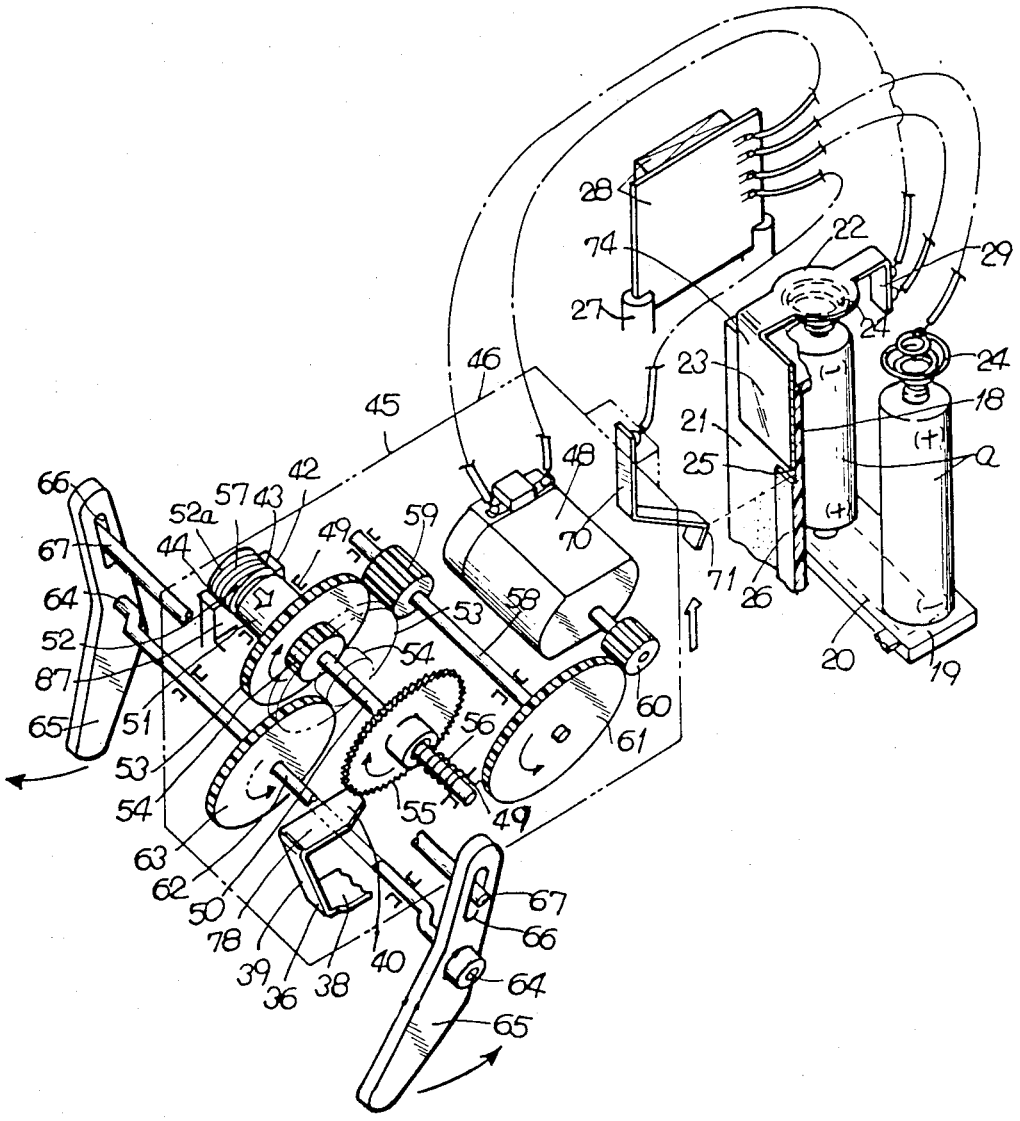
FIG. 1 is an exploded view in perspective of a motion change-over structure for a motion toy.
Figure 2:
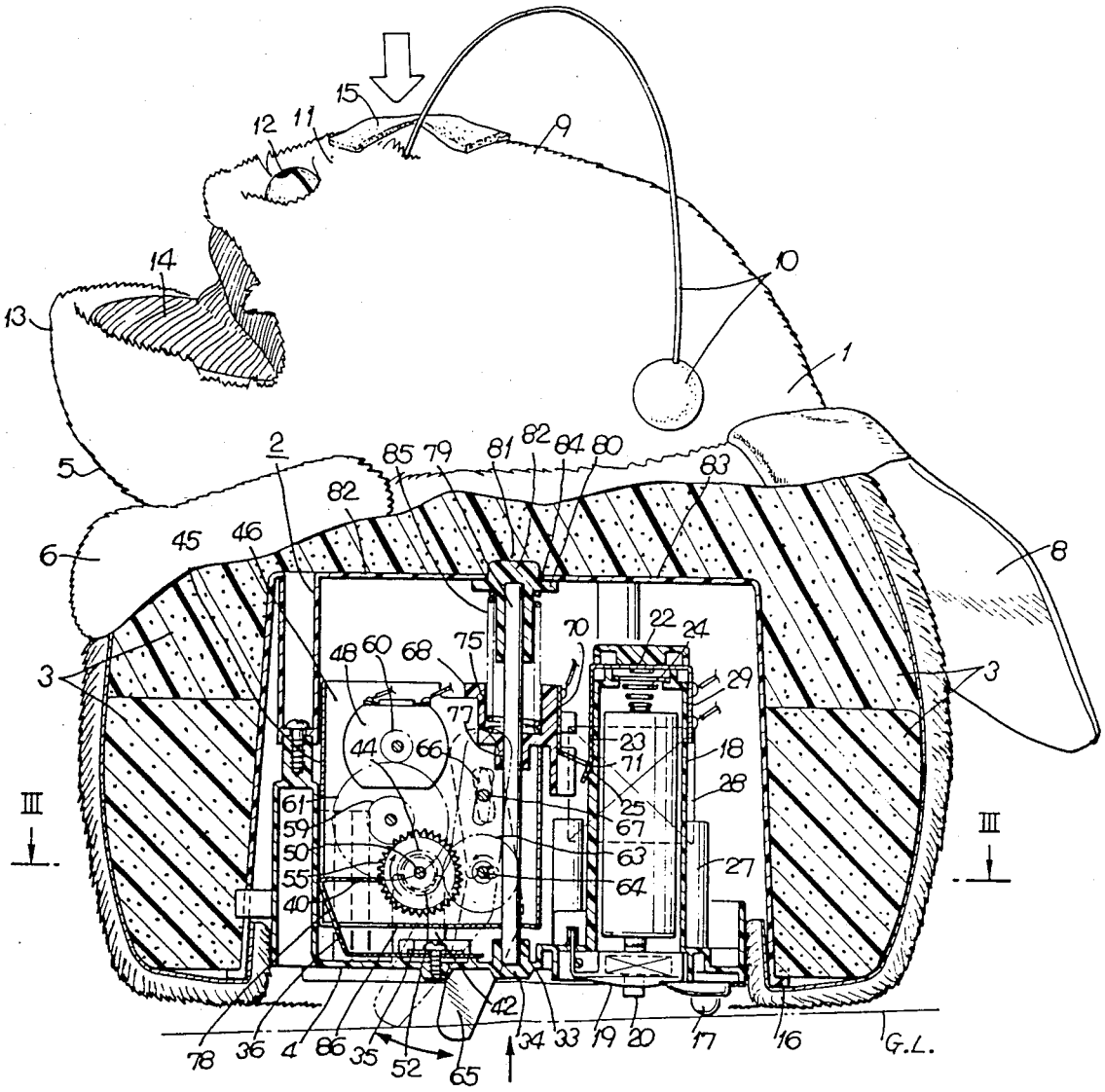
FIG. 2 is a side elevation showing the construction of the inner portion of a motion toy using this motion change-over structure.
Figure 4:
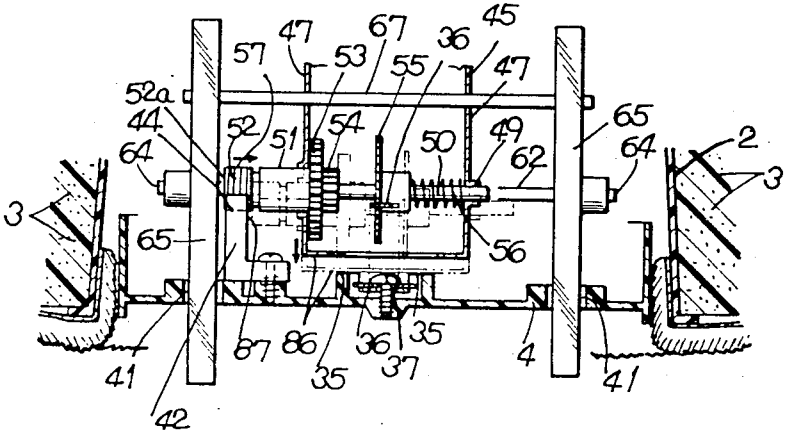
FIG. 4 is a sectional view taken along the line IV—IV in FIG. 3.
Figure 3:
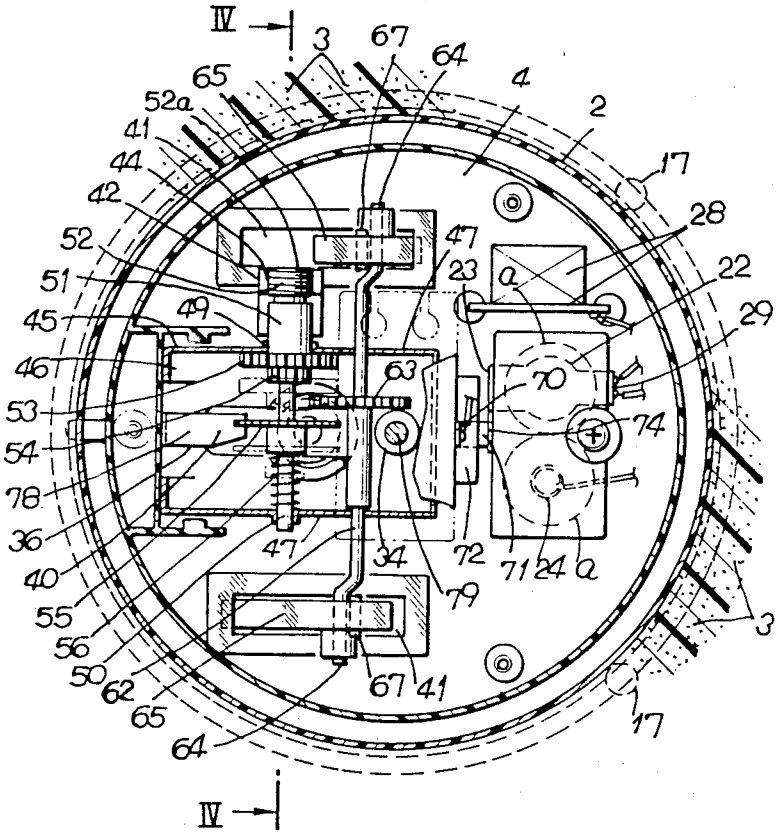
FIG. 3 is a sectional view taken along the line III—III in FIG. 2.
Figure 5:
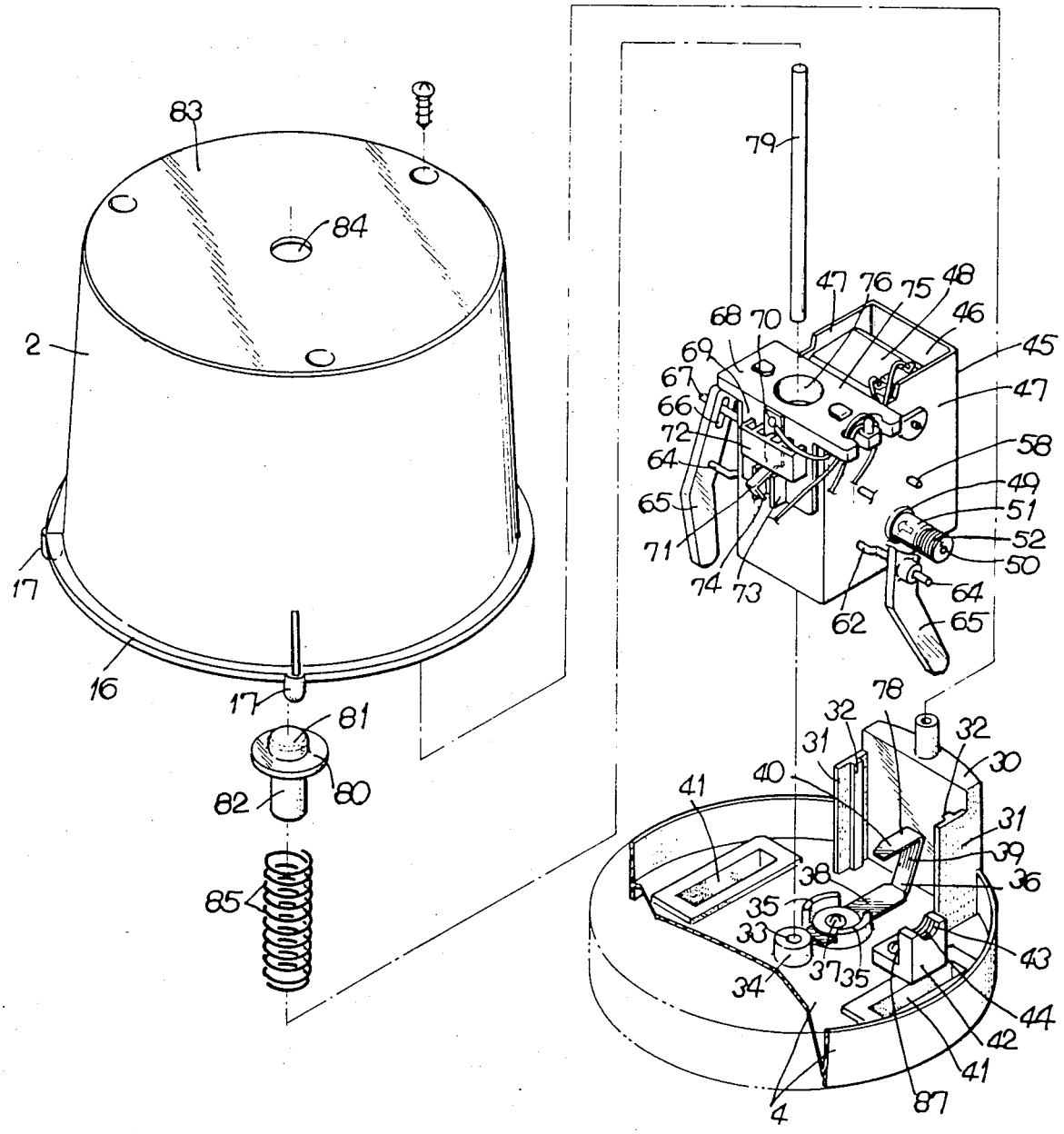
FIG. 5 is an exploded view in perspective of what is shown in FIG. 2.
Figure 7:
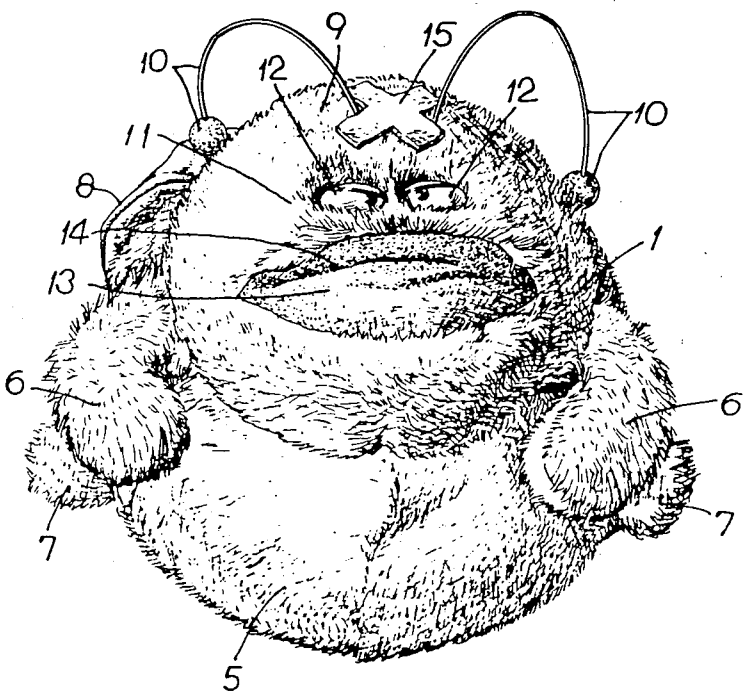
FIG. 7 is a perspective view of the motion toy.
Figure 6:
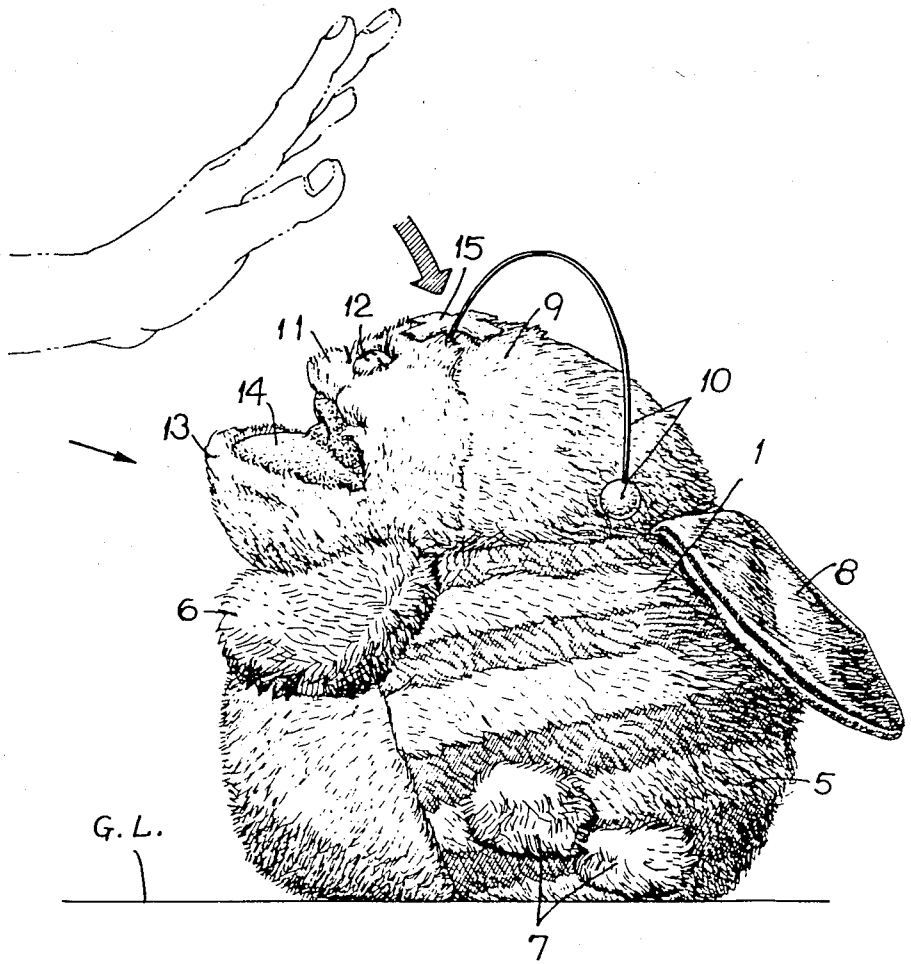
FIG. 6 is a side elevation of the motion toy.
Figure 8:
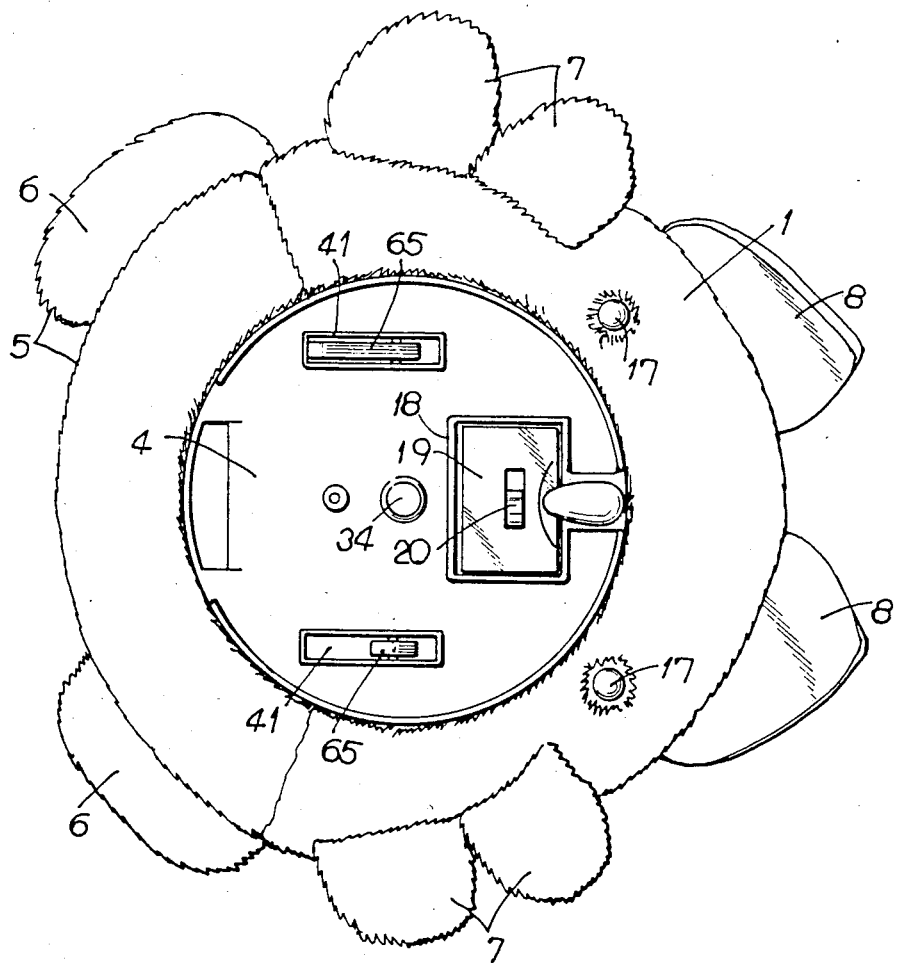
FIG. 8 is a bottom view of the motion toy.

Referring to the drawings, reference numeral 1 denotes a toy body of an imitation animal, which consists of a lower side-opened cylindrical housing 2 provided in a trunk, shape-retaining cushion materials 3 packed in the circumferential portion of the housing 2 and from the portion on the upper side of the housing 2 to the interior of a head 9, a bottom member 4 fixed in the opened lower side portion of the housing 2 and serving as a circular part of the housing 2, and a haired coat 5 covering these parts and formed by imitating the shape of an animal. This haired coat 5 is provided additionally with left and right hands 6, 6, left and right feet 7, 7, left and right wings 8, 8, antennae 10, 10 fixed to the head 9 the shape of which is retained by the cushion material 3, left and right eyeballs 12, 12 and a mouth 14 with a forwardly-projecting lower jaw 13 on a face portion 11 of the head 9, and a mark 15 on the upper portion of the head 9. A cylindrical flange 16 supporting the inner lower end of the cushion material 3 is formed at the outer circumferential portion of the lower opened side of the housing 2, and floor-contacting projections 17 are provided at the left and right sides of the front and rear portions of the lower part of the flange 16 so that the left and right projections are spaced at a predetermined distance.

A battery case 18 of a synthetic resin containing batteries a, a is formed on one side of and integrally with the bottom member 4, and a main switch 20 which is adapted to turn on and off a power source circuit including these batteries a, a is provided on a cover 19 used to open and close the battery case 18. One fixed terminal 23 of a fixed terminal plate 22 is attached to the upper portion of a front wall 21 of the battery case 18, and this fixed terminal plate 22 is joined to one of connecting terminals 24, 24 for the batteries a, a fixed to an upper wall of the battery case 18. A guide plate 26 is fixed to a portion of the front wall 21 which is below the lower end of the above-mentioned fixed terminal 23 of the fixed terminal plate 22 so that the guide plate 26 is spaced from the fixed terminal 23 via a stepped portion 25 of a predetermined length. A support frame 27 is provided so as to project from one side portion of the battery case 18, and a timer 28 is supported on this support frame 27. This timer 28 is connected to the other fixed terminal 29 of the fixed terminal plate 22 and the other connecting terminal 24. A guide support frame 30 is provided integrally with the bottom member 4 at a portion which is on the opposite side of the battery case 18, and guide projections 32, 32 are formed in opposed and vertically-extending state on the left and right side walls 31, 31 of this guide support frame 30. A bearing 34 having a locking bore 33 is provided so as to project upward from the substantially central portion of the bottom member 4. Arcuate machine frame-supporting members 35, 35 are provided in opposed state so as to project upward from the portions of the bottom member 4 which are in the vicinity of the bearing 34 and on the side of the guide support frame 30. The base portion of a singing member 36 consisting of a plate spring is fixed by a screw 37 between these opposed frame-supporting members 35, 35, and this singing member 36 has a horizontal portion 38 extending from this base portion toward the guide support frame 30, a rising portion 39 being formed so as to extend upward from the tip of the horizontal portion 38, a slide portion 40 being formed so as to extend from the upper end of the rising portion 39 to the side of the base portion. Longitudinally-elongated guide bores 41, 41 are formed in parallel with each other in opposed state in the left and right side portions of the bottom member 4, and a support member 42 is fixed to the inner edge portion of one foot guide bore 41. A feed screw 44 consisting of a right-hand screw is formed in a substantially semicircular support recess 43 formed in the upper end portion of this support member 42.

A driving mechanism 45 is provided on the bottom member 4. This driving mechanism 45 has a frame 46 of such dimensions that enable the frame 46 to be inserted between the front wall 21 of the battery case 18 and guide projections 32, 32 on the side walls 31, 31 of the guide support frame 30 and moved vertically in this space. An electric motor 48 is fixed between upper portions of one side sections of left and right side walls 47, 47 of the frame 46, and connected to the timer 28 and the fixed terminal 29 on the fixed terminal plate 22. Bearing bores 49, 49 are formed in opposed state in the lower portions of the left and right side walls 47, 47 of the frame 46, and both end portions of a slide shaft 50 are fitted in these left and right bearing bores 49, 49 so that the slide shaft 50 can be axially moved and turned. A guide cylinder 51, which is inserted in the larger bearing bore, one of the bearing bores 49, in such a manner that the guide cylinder 51 can be turned and slidingly moved axially, and which consists of a synthetic resin and serves also as a spacer, is mounted fixedly on one end portion of this slide shaft 50. A screw member **52*a* having a screw 52 consisting of a left-hand screw, which is engageable with and disengageable from the feed screw 44 on the support member 42, is mounted fixedly on a portion of the slide shaft 50 which is on the outer side of the outer end of the guide cylinder 51. An input gear 53 and a change-over gear 54 are mounted fixedly in parallel with each other on a portion of the slide shaft 50 which is on the inner side of the inner end of the guide cylinder 51. A singing gear 55 which is engageable with and disengageable from the slide portion 40 of the singing member 36 is mounted fixedly on a portion of the slide shaft 50 which is in the vicinity of the other end thereof. A coiled spring 56 urging the slide shaft 50 constantly in the axial direction toward the support member 42 is fitted around a portion of the slide shaft 50 which is between the singing gear 55 and the left wall 47 of the frame 46. The feed screw 44 on the support member 42, slide shaft 50 and screw 52 on the screw member 2*a* in the slide shaft 50 form a motion change-over structure 57 for switching the position of the change-over gear 54. The singing member 36 having the slide portion 40 and the singing gear 55 form a singing mechanism 78**.

A rotary shaft 58 is also supported between the left and right side walls 47, 47 of the frame 46 so that the shaft 58 can be turned. A drive gear 59 constantly meshed with and adapted to turn the input gear 53 is mounted fixedly on one end portion of this rotary shaft 58. A reduction gear 61 meshed with a pinion 60 for the electric motor 48 is mounted fixedly on the other end portion of the rotary shaft 58. A crankshaft 62 is supported between the lower portions of the front side sections of the left and right walls 47, 47 of the frame 46 so that the crankshaft can be turned. A foot driving gear 63, which is engageable with and disengageable from the change-over gear 54, is mounted fixedly on substantially intermediate portion of the crankshaft 62. Left and right feet 65, 65, which work as a motion mechanism, are supported pivotably at their upper portions on left and right crank arms 64, 64 of the crankshaft 62. The lower end portions of these left and right feet 65, 65 are projected downward from the foot guide bores 41, 41 made in the left and right portions of the bottom member 4, in such a manner that the lower end portions of the feet can be moved in the longitudinal direction. Both end portions of a support rod 67 supported on the left and right walls 47, 47 of the frame 46 are inserted in vertically-elongated guide bores 66, 66 formed in the upper portions of these left and right feet 65, 65. A retainer frame 68 made of a synthetic resin is fixed to the upper portion of the rear side section of the frame 46, and the base portion of a movable terminal plate 70 is fixed to a vertical portion 69 of this retainer frame 68. A bent movable terminal 71 formed at the lower end portion of the movable terminal plate 70 projects so that it can be moved rearward. The movable terminal 71 is adapted to engage and disengage from the fixed terminal 23, and the movable terminal plate 70 is connected to the timer 28. The base portion of the movable terminal plate 70 is held from the outer surface thereof by a support frame 72 of a synthetic resin fixed to the vertical portion 69, and the movable terminal 71 is adapted to be moved forward and backward in the space between opposed guides 73 fixed to the vertical portion 69. The movable terminal plate 70 having the movable terminal 71 and the fixed terminal plate 22 having the fixed terminal 23 form a switch mechanism 74 for turning on and off the driving circuit consisting of the electric motor 48 and the timer 28. A horizontal portion 75 of the retainer frame 68 is provided at the central section thereof with a cylindrical holder 76, which has at the bottom portion thereof a through bore 77 corresponding to the locking bore 33 in the bearing member 34. The lower end portion of a guide rod 79 is inserted through the bore 77 in the retainer frame 68 into the locking bore 33 in the bearing member 34 and fixed therein. The driving mechanism 45 is guided via this guide rod 79 so that the driving mechanism 45 can be vertically moved. A locking member 82 having a flange 80 and a locking projection 81 is fitted around the upper end portion of this guide rod 79, and the locking projection 81 of this locking member 82 is fitted in a locking bore 84 formed in the central portion of a top wall 83 of the housing 2, a coiled spring 85 being provided around a portion of the guide rod 79 which is between the flange 80 of the locking member 82 and the bottom portion of the holder 76 in the retainer frame 68. Owing to this coiled spring 85, the driving mechanism 45 is urged constantly in the downward direction along the guide rod 79 with the floor-contacting projections 17, 17 contacting the floor surface G.L., and a bottom wall 86 of the frame 46 of this driving mechanism 45 is supported by the frame-supporting members 35, 35 with the lower end portions of the left and right feet 65 in the driving mechanism 45 contacting the floor surface G.L. When the screw 52 on the slide shaft 50 is disengaged from the feed screw 44 on the support member 42 against the coiled spring 56, the end surface of the screw member 52*a* moves from this feed screw 44 to engage a vertical guide surface 87 at the lower portion of the inner end of the support member 42, and the singing gear 55 on the slide shaft 50 disengages from the slide portion 40 of the singing member 36, the movable terminal 71 on the movable terminal plate 70 engaging the guide plate 26, which is below the connecting stepped portion 25, without contacting the fixed terminal 23, whereby the switch mechanism 74 is kept in OFF-state.

The operation of this embodiment will now be described.

First, the main switch 20 is turned on. Consequently, the power source circuit is closed but the switch mechanism 74 for the driving mechanism 45 is in OFF-state.

When the upper portion of the head 9 of the toy body 1, i.e. the portion of the head 9 which has the mark 15 is knocked down, the driving mechanism 45 is lifted along the guide rod 79 against the coiled spring 85 as the driving mechanism 45 is supported on the lower end portions of the left and right feet 65, 65 contacting the floor surface G.L. with the housing 2 being not moved due to the plural projections 17, 17 contacting the floor surface G.L. As the driving mechanism 45 is lifted, the end surface of the screw member 52*a* on the slide shaft 50 disengages upward from the guide surface 87 on the inner side of the support member 42, and the slide shaft 50 is moved automatically in the axial direction toward the support member 42 due to the return force of the compressed coiled spring 56 to cause the screw 52 thereon to be meshed momentarily with the feed screw 44 on the support member 42. Simultaneously with the meshing of the feed screw 44 with the screw 52 on the slide shaft 50, the singing gear 55 on the slide shaft 50 engages the slide portion 40 of the singing member 36. When the driving mechanism 45 is lifted to cause the feed screw 44 and screw 52 to be meshed as mentioned above, the movable terminal 71 on the movable terminal plate 70 in the driving mechanism 45 is moved along the guide plate 26 to the connecting stepped portion 25 which is above the guide plate 26, and connected momentarily in the connecting stepped portion 25 to the fixed terminal 23 on the fixed terminal plate 22, so that the switch mechanism 74 is turned on. When the switch mechanism 74 is turned on, the timer 28 and electric motor 48 are operated, so that the driving gear 59 is turned via the pinion 60 for the electric motor 48, reduction gear 61 and rotary shaft 58. The turning of the driving gear 59 causes the slide shaft 50 to be turned via the input gear 53, and the screw 52 on one end portion of the slide shaft 50 is turned with respect to the feed screw 44 on the support member 42. At the same time, the singing gear 55 moves the slide portion 40 of the singing member 36 intermittently in minced steps in sliding manner by the teeth thereof against the resilient force of the slide portion 40. The screw 52 on the slide shaft 50 is moved in the axial direction by the feed screw 44 as the screw 52 is turned, and the slide shaft 50 is moved axially as it compresses the coiled spring 56 against the resilient force thereof, the singing gear 55 on the slide shaft 50 being moved axially as it is slidingly turned on the slide portion 40. During this time, i.e., while the singing gear 55 is slidingly turned with respect to the slide portion 40, a frictional metallic sound occurs momentarily. This frictional sound is amplified in the interior of the frame 46 for the driving mechanism 45 and the guide support frame 30, and heard like a scream of an animal. The length of this scream is proportional to that of the time during which the singing gear 55 is slidingly turned with respect to the slide portion 40. Therefore, when the head 9 is knocked, the toy body 1 makes a screaming action momentarily.

When the screw 52 on the slide shaft 50 is further moved axially by the feed screw 44, it disengages from the feed screw 44, and, due to the axial movement of the slide shaft 50, the singing gear 55 disengages from the slide portion 40, so that the generation of the scream is interrupted. In the meantime, due to this axial movement of the slide shaft 50, the change-over gear 54 is meshed with the foot-driving gear 63.

When the screw 52 on the slide shaft 50 disengages from the feed screw 44, the driving mechanism 45 is moved down along the guide rod 79 due to the return force of the coiled spring 85, and the end surface of the screw member 52*a* engages the guide surface 87 on the inner side of the support member 42. Consequently, the bottom wall 86 of the frame 46 is supported on the frame-supporting members 35, 35, and the left and right feet 65, 65 project to press at the lower end portions of these feet the floor surface G.L., so that the toy body 1 is inclined slightly in the rearward direction around the left and right rear floor surface-contacting projections 17, 17 as fulcrums. The movable terminal 71 then disengages from the fixed terminal 23 and engages the guide plate 26 to thereby cause the switch mechanism 74 to be turned off. Even when the switch mechanism 74 is turned off, the operation of the driving mechanism 45 is not interrupted immediately. Namely, the electric motor 48 continues to be operated due to the operation of the timer 28, and the pinion 60, reduction gear 61 and driving gear 59 are turned. The input gear 53 continues to be turned, and, owing to the change-over gear 54 which is mounted on the same shaft as the input gear 53, the foot-driving gear 63 meshed with the change-over gear 54 is also turned. Due to the turning of the foot-driving gear 63, the crankshaft 62 is turned to cause the left and right feet 65, 65 to be moved forward and backward alternately via the pivotal movements of the crank arms 64, 64 at both end portions of the crankshaft 62, so that the toy body 1 walks forward for a predetermined period of time. Therefore, when the head 9 is knocked, the toy body 1 makes a screaming action momentarily, and, simultaneously with the interruption of the screaming action, the toy body 1 makes a sneaking action, i.e., it walks forward for a predetermined period of time set by the timer 28, for example, several seconds.

When a predetermined period of time set by the timer 28 for making the forward walking action of the toy body 1 has elapsed, the timer 28 is turned off, and the toy body 1 stops making the forward walking action. Unless the head 9 is knocked again, each of such actions is not made even if the main switch 20 is left in ON-state.

In the embodiment described above, the pinion 60 for the electric motor 48 is turned in only one direction but the pinion 60 is not limited to such a pinion. The pinion 60 for the electric motor 48 may consist of a pinion driven in the forward and backward directions by a switching operation. The feed screw 44 may be formed in a through bore in the central portion of the input gear 53 so that the screw 52 on the slide shaft 50 can engage this feed screw 44 and be turned and moved axially through this feed screw 44.

According to the present invention, the screw on the slide shaft is engaged with the feed screw, so that, when the slide shaft is turned, it can be moved simply and reliably in the axial direction by the feed screw to also enable the change-over gear mounted on the slide shaft to be meshed with or disengaged from the gear by which the power is transmitted to the motion mechanism. If the length of the screw, which is adapted to be engaged with the feed screw, on the slide shaft is selectively determined, the quantity of axial movement of the slide shaft can be regulated correspondingly to the length and number of the gear by which the power is transmitted to the motion mechanism, and the transmission of the power of the gear and the switching of the axial movement of the slide shaft can be done reliably. Since the rotation of the slide shaft is converted immediately to the axial movement thereof, the power switching operation can be carried out smoothly and reliably. Accordingly, a motion change-over structure for motion toys, which can be manufactured at a low cost with a smaller number of parts, and which is free from the problem of strength, can be provided, this motion change-over structure being unlike a motion change-over structure which is provided with two interlocking gears having different numbers of teeth and adapted to be driven simultaneously, and which therefore requires a specially high manufacturing accuracy.

According to another embodiment of the present invention, a motion toy is made by using this motion change-over structure. Therefore, when the head of the toy body is knocked, the motion change-over structure is driven, and the switch mechanism is turned on automatically. Owing to the operation of the motion change-over structure, the singing gear and singing member interact to generate a screaming sound. Namely, when the head of the toy body is knocked, the toy body makes in reaction a screaming action. When a switching operation is carried out by the motion change-over structure, the generation of the scream is interrupted, and the left and right feet are moved forward and backward, i.e., the toy body makes a forwardly-walking action. Therefore, when the head is knocked, the toy body screams immediately, and walks about in a flurry owing to the switching operation of the motion changeover structure. The present invention can provide a very interesting motion toy adapted to make such unique actions.

What is claimed is:

1. A motion toy comprising a toy body consisting of a trunk containing a housing therein, and a head; a frame which is provided in said housing in said toy body so that said frame can be vertically moved, and which supports thereon a crankshaft, on which left and right feet are mounted so that said feet can be moved forward and backward, in such a manner that said crankshaft extends horizontally and can be turned; a slide shaft which is supported by said frame so that said slide shaft can be moved axially and turned, and which has thereon a change-over gear, which is adapted to engage and disengage from a foot-driving gear by which a power is transmitted to said crankshaft, and a singing gear; a screw formed to a predetermined length on the outer circumferential surface of said slide shaft; a support member fixed to a bottom member of said housing and having on the upper portion thereof a feed screw adapted to be engaged with and disengaged from said screw on said slide shaft and thereby move said slide shaft when said feed screw is engaged with said screw on said slide shaft, in the axial direction as said slide shaft is turned; a spring fitted around said slide shaft and urging said slide shaft constantly toward said support member; an electric motor fixed to said frame and adapted to turn said slide shaft; a spring provided between said housing and said frame and resiliently supporting said frame with said screw on said slide shaft lower than said feed screw on said support member; a switch mechanism adapted to energize said electric motor when said frame is raised against said spring; and a singing member provided on said bottom member of said housing and having a slide portion which said singing gear engages and disengages from.

* * * * *